United States Patent [19]

Rybka, deceased

[11] Patent Number: 4,936,414

[45] Date of Patent: Jun. 26, 1990

[54] DETACHABLE SELF-CONTAINED-AERIAL-MAINTENANCE PLATFORM

[75] Inventor: John J. Rybka, deceased, late of Tacoma, Wash., by Nancy Rybka, executrix

[73] Assignee: Norpac Engineering, Inc., Seattle, Wash.

[21] Appl. No.: 332,693

[22] Filed: Mar. 31, 1989

[51] Int. Cl.[5] ..... B66F 11/04

[52] U.S. Cl. ..... 182/2; 182/63

[58] Field of Search ..... 182/2, 142, 150, 128, 182/63, 36

[56] References Cited

U.S. PATENT DOCUMENTS

| | | | |
|---|---|---|---|
| 3,415,339 | 12/1968 | Range | 182/2 |
| 3,820,631 | 6/1974 | King et al. | 182/63 X |
| 4,546,852 | 10/1985 | Martin et al. | 182/12 |
| 4,676,339 | 6/1987 | Rybka et al. | 182/63 X |

FOREIGN PATENT DOCUMENTS

| | | | |
|---|---|---|---|
| 3502583 | 7/1986 | Fed. Rep. of Germany | 182/2 |
| 1337059 | 11/1973 | United Kingdom | 182/2 |

*Primary Examiner*—Ramon S. Britts
*Assistant Examiner*—Karen J. Chotkowski
*Attorney, Agent, or Firm*—Sachs & Sachs

[57] ABSTRACT

An apparatus for maintaining and inspecting a dockside container crane includes a framework and a base for supporting thereon a rotatable turret having a telescopic boom and platform member. The base and framework is removably attachable to a standard ISO container, and once attached the ISO container may then be raised by the dockside container crane, via a standard spreader, where an inspector or workman manipulates controls on the platform member to operate the turret and telescopic boom, to position the platform member near a portion of the crane requiring inspection or service.

8 Claims, 5 Drawing Sheets

DETACHABLE SELF-CONTAINED-AERIAL-MAINTENANCE PLATFORM

BACKGROUND OF THE INVENTION

1. Field of the Invention

The present invention relates to an apparatus for inspecting and maintaining cranes, and more particularly relates to a detachable apparatus for inspecting and maintaining dockside container cranes and other large cranes.

2. Discussion of the Relevant Art

Dockside container cranes and other large cranes frequently require maintenance and repair. Typical maintenance includes painting, mechanical repair and lubrication, due principally to wear and exposure to the weather. Many areas of the crane structure are inaccessible to repairmen due to the height of the crane and the infeasibility of providing safe walkways to access all portions of the structure.

Several devices have been designed to assist in giving repairmen access to the crane structure, such as that disclosed in U.S. Pat. No. 4,676,339, to Rybka, et al and disclosed in U.S. Pat. No. 4,546,852 to Martin et al. Both of these devices use the crane's lifting mechanism to lift a base unit containing extendable manlift platforms which can be extended into proximity of the area of the crane requiring service. The known devices employ large, unwieldy, and costly base units on which the articulated elements of the device are installed. These base units are difficult to store because of their size; are costly, since they must be fabricated for this special application; and are unwieldy, because of the combined weight of the base together with the articulated elements.

SUMMARY OF THE INVENTION

It is an object of the invention to provide an apparatus for inspecting and maintaining large cranes which may be conveniently attached to and detached from a standard ISO container.

It is a further object of the present invention to provide a crane inspection and maintenance device which is light in weight, portable, easily stored and economical to construct.

The present invention overcomes the problems found in the prior art devices by providing a detachable maintenance platform which is removably affixed to a standard ISO container provided with a plurality of corner fittings attached to the container's exterior corners. A generally flat base member has a framework attached on one end. The framework has at least a pair of outwardly directed extensions each with mating fittings that cooperate with the corner fittings on the container that permits the removable attachment of the framework and base member. The base member provides a mounting for a rotatable turret. A telescopically extending boom is pivotally secured at one end to the turret and a platform is affixed at the other end of the boom. A control apparatus is disposed on the platform which permits the positioning of the platform at desired locations relative to the dockside container crane.

BRIEF DESCRIPTION OF THE DRAWING

The invention will now be described by way of example with reference to the accompanying drawings in which.

DESCRIPTION OF THE PREFERRED EMBODIMENT OF THE INVENTION

Figure 1:
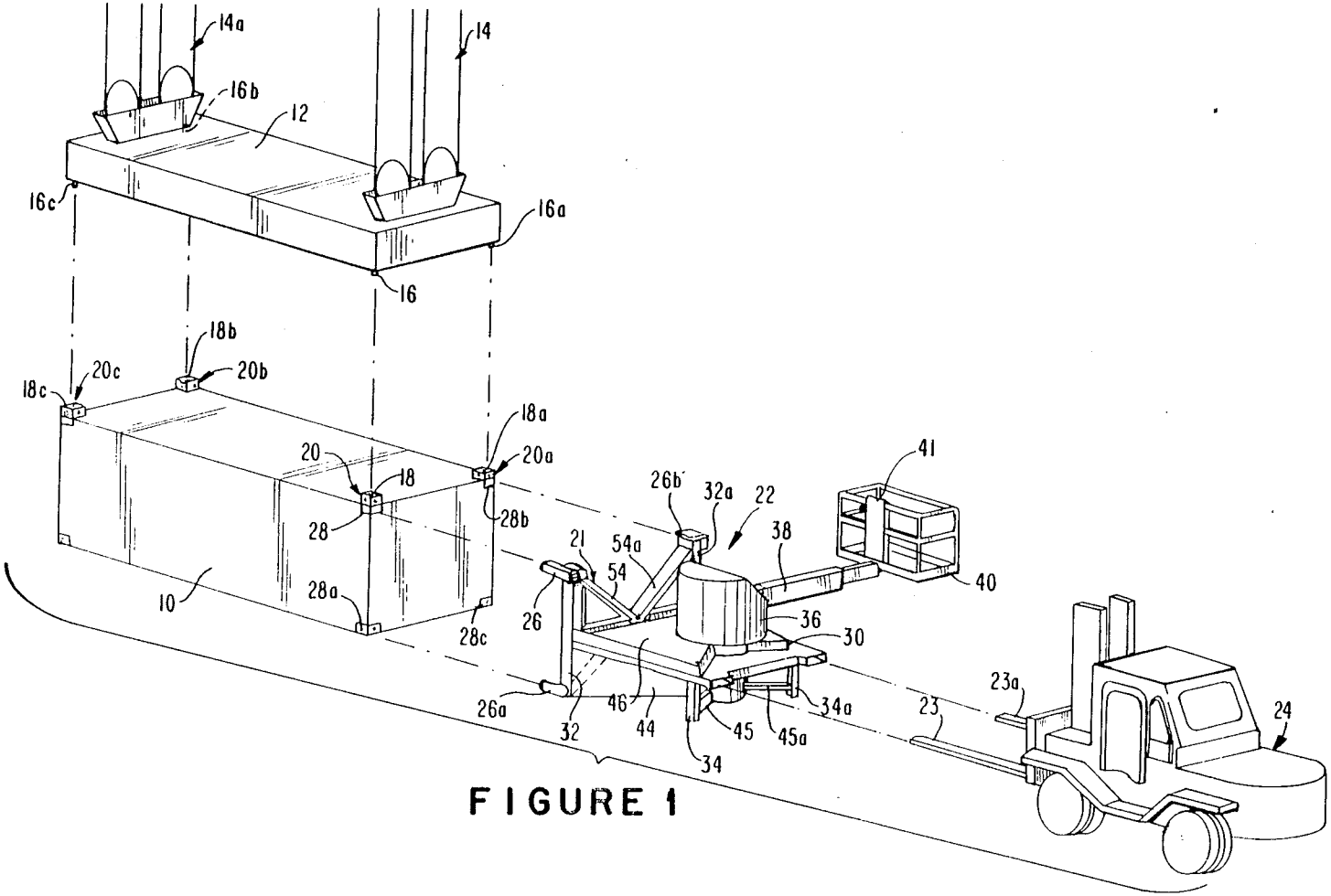
FIG. 1 is an exploded pictorial representation of the detachable apparatus removed from a fork lift truck and in position to be attached to an ISO container according to the principles of the invention.

Referring now to the figures, and more particularly to FIG. 1, a conventional ISO Container 10, well known by those skilled in the art, is shown is position for attachment to a spreader assembly 12. The spreader assembly 12 is lowered, via cables 14, which attach to and are controlled by a dockside container crane, not shown, and which is shown in more detail in U.S. Pat. No. 4,676,339 to Rybka, et al. The crane lowers the spreader assembly 12 upon the ISO container 10 such that grasping devices 16, **16*a*, 16*b* and 16*c* provided on the spreader assembly 12 enter into top orifices 18, 18*a*, 18*b* and 18*c*, respectively, provided in the corner fitting adaptors 20, 20*a*, 20*b* and 20*c* and lock within the orifices 18**; and cannot be withdrawn until unlocked by an individual.

When the grasping devices 16, **16*a*, 16*b* and 16*c* are locked into the orifices 18, 18*a*, 18*b* and 18*c*, the crane, not shown, can lift the ISO container, via the spreader assembly 12 and cables 14 and 14*a***. The components referred to above and their operation, as heretofore described, are all conventional and well known to those with skill in the art.

A detachable, self contained, aerial maintenance platform apparatus 22 sometimes referred to as a SCAMP, according to the principles of the present invention as shown in FIG. 1 removed from a forklift truck 24 in proximity to the ISO container 10. To utilize the SCAMP 22 to perform maintenance operations, it must be positioned relative to the ISO container 10 such that outwardly protruding extension portions 26, **26*a*, 26*b* and 26*c* provided on a framework member 21 embrace, mate and cooperate with four juxtaposed corner fittings 28, 28*a*, 28*b* and 28*c*, respectively, which permit the removable attachment of the SCAMP 22 to the ISO container 10**.

Figure 2:
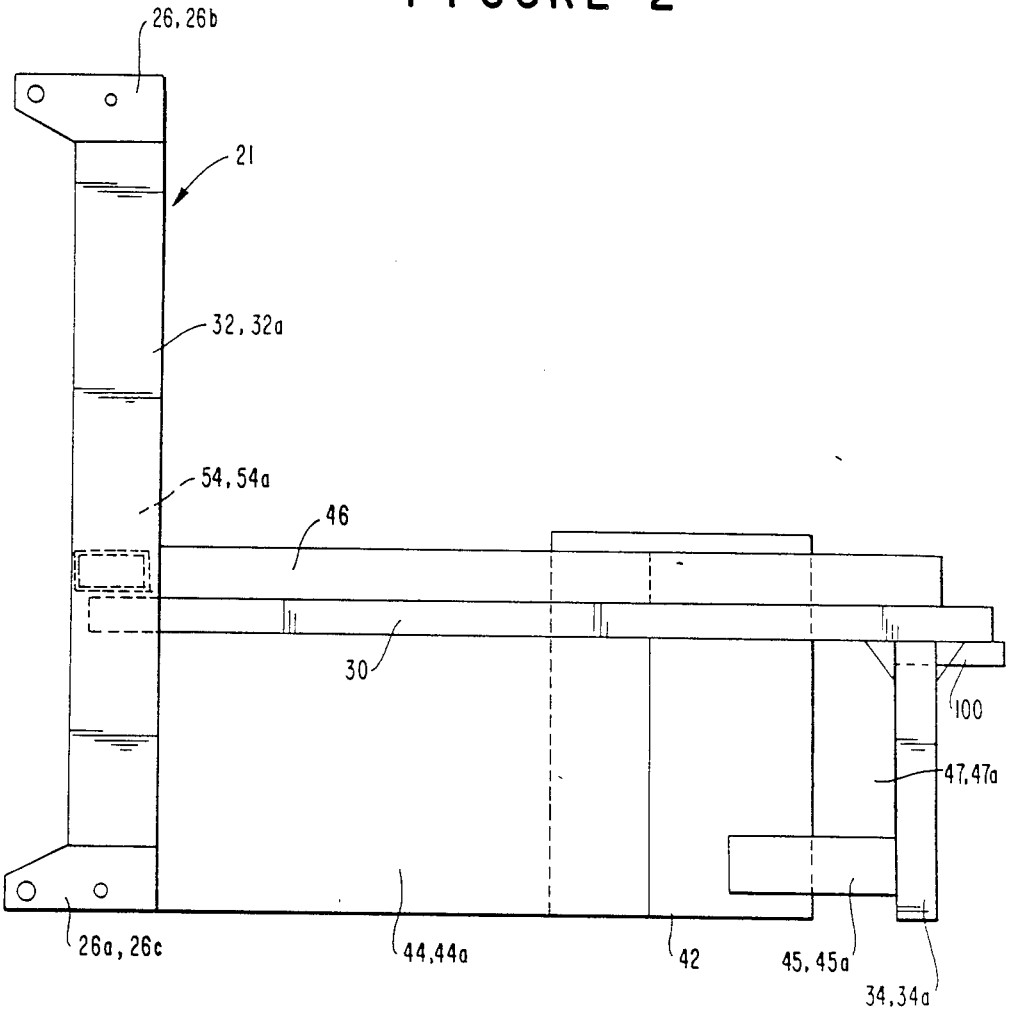
FIG. 2 is an enlarged side view in elevation of the detachable apparatus of FIG. 1 without articulating elements.

The framework member 21 includes arm members 32 and **32*a* and leg members 34 and 34*a* all of which is attached to base member 30 at one end as shown in more detail in FIG. 2. A rotatable turret 36 is mounted on base member 30 and is provided with a telescopic boom 38 which is pivotally attached at one end thereof to the rotatable turret 36, with a work platform 40 affixed to the other end thereof. The controls 41 are preferably disposed on the work platform 40** for easy access by an individual, not shown, that is to perform the repairs and maintenance on the crane, not shown.

FIG. 2 shows the construction of the framework 21 of present invention without the rotatable turret 36 or other articulating elements installed thereon. The arm members 32 and 32*a* shown are preferably fabricated from rectangularly shaped tubular steel, attached to base member 30 at an angle of approximately 90 degrees or generally perpendicular thereto. A cylindrical member 42 adapted to receive the turret 36 therein extends through the base member 30 and is affixed thereto. Bracing members 44, 44*a* and 45, 45*a* extend between arms 32, 32*a* and attach to the cylindrical member 42 and one end of the framework member 21 for structural support and to the legs 34 and bracing member 47 and 47*a* which are attached at the other end on the underside of the base member 30 extending downwardly to ground level.

The preferred embodiment shown in FIG. 2 includes a second support tier 46 for the base 30, which is conventional in design and provides the structural rigidity and maintains the mechanical integrity of the apparatus.

Figure 3:
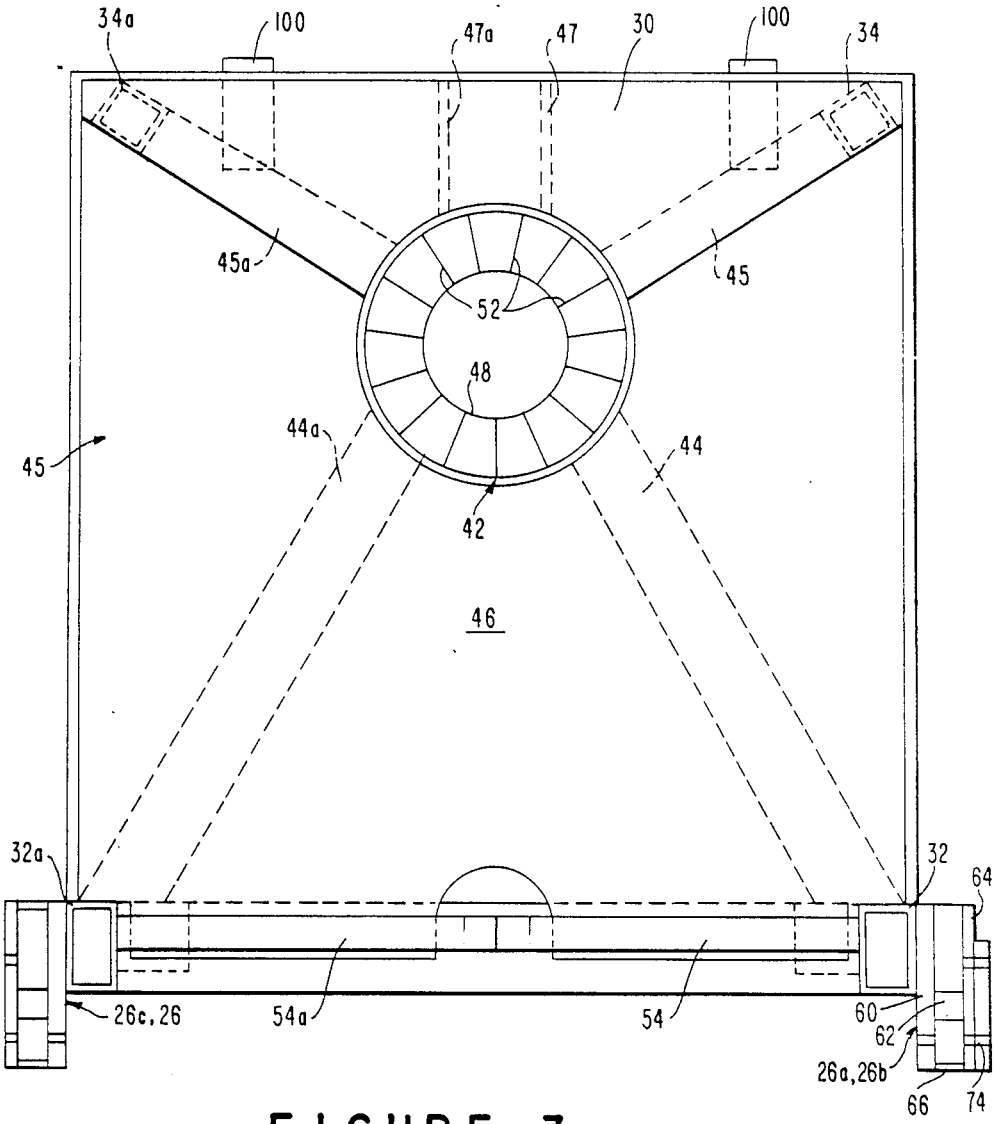
FIG. 3 is an enlarged top plan view of the detachable apparatus shown in FIG. 1.

Referring now to FIG. 3, the cylindrical member 42 is constructed to include an inner cylinder 48, and a plurality of radial braces 52 extending the length of and interposed therebetween and rigidly affixed by conventional welding to both. Further illustrated is rectangularly shaped tubular bracing member 54 which is preferably formed in the shape of an "X" for rigidity.

The intersection of the "X" being in the plane of the base 30 with the ends of the bracing member being attached to the corresponding ends of the arm members 32 and 32*a* of framework member 21.

Walking surfaces 56 and 58 such as serrations or knurling may be provided to members 46 and to provide a non-slip walking surface.

In accordance with the preferred embodiment, two tine sockets 100 are attached to the base member 30 spaced apart to permit the insertion therein of the two tines 23 and 23*a* of the forklift truck 24.

Figure 4:
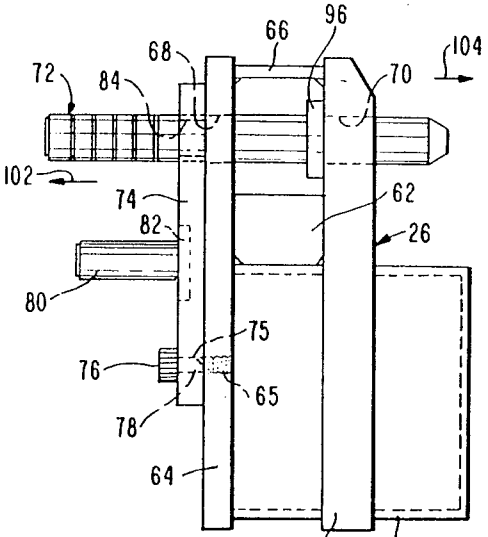
FIG. 4 is an enlarged top plan view of the frame extension portion used for attaching the device to an ISO container.

A detailed drawing of the extension portion 26 provided on frame 21 is shown in FIG. 4. It is to be understood that although only extensions portion 26 is to be described, extension portions 26, 26*a*, 26*b* and 26*c* are fabricated in an identical manner. In the preferred embodiment depicted, an inner plate 60 is affixed to one end of the framework arm member 32. A spacer 62 is affixed to the inner plate 60 and an outer plate 64 is affixed to the opposite side of the spacer 62 in a conventional manner. All attachments may be made by welding or other conventional means, e.g., bolts, rivets, etc. An end brace 66 interposed between and attached to the inner and outer plates 60 and 64 completes a box shaped end portion having an open top and bottom. Concentric bores 68 and 70 are provided in the outer plate 64 and inner plate 60, respectively, through which a locking pin 72 is inserted.

Figure 5:
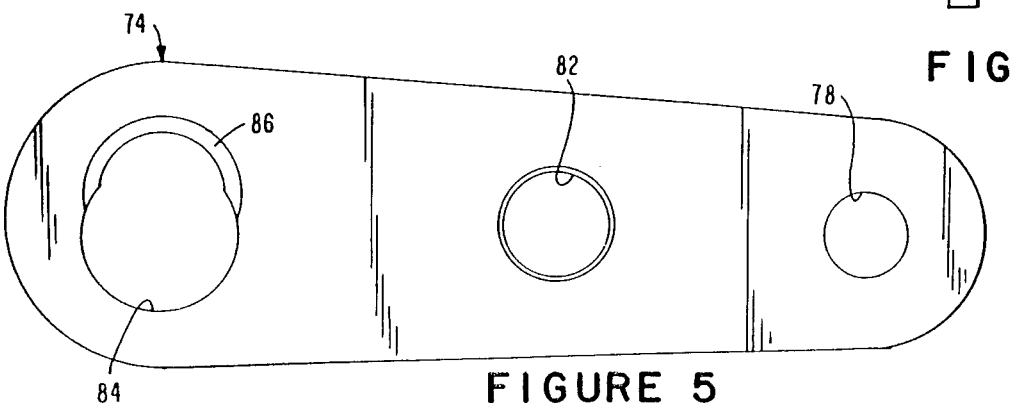
FIG. 5 is an enlarged top plan view of a locking bar used on the apparatus shown in FIG. 1.

A locking bar 74, shown in FIG. 5, is affixed to the outer plate 64, via a threaded shoulder through bolt 76, which passes through a bolt opening 78 provided in the locking bar 74 and is threaded into the outer plate 64 and allows the locking bar 74 to pivot upon the clear portion 75 of through bolt 76. A handle 80 is provided in opening 82 provided in the locking bar 74 which may be retained therein by friction, welding or other conventional means. The handle 80 permits convenient and safe control over the pivoting of the locking bar 74. An opening 84 is provided in locking bar 74 and is fabricated by cutting two circular bore holes having unequal radii, with the centers spaced apart. The periphery of the smaller of the two bores, is spotfaced with the larger drill bit to form an edge 86.

Figure 6:
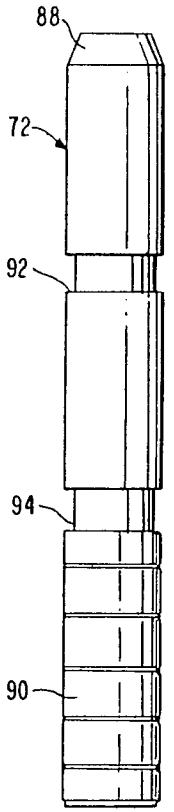
FIG. 6 is an enlarged top view of the locking pin used on the apparatus of FIG. 1.
Figure 7:
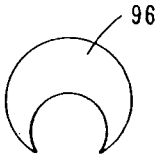
FIG. 7 is an enlarged top view of a locking bar snap ring used with the apparatus of FIG. 1.

The locking pin 72, shown in FIG. 6, is provided with a tapered end 88 and a hand grip end 90 which is grooved or knurled to increase the frictional grip of the hand of a user. A locking collar groove 92 and a locking bar groove 94 are also provided in locking pin 74. The locking collar groove 92 is used to receive and retain a locking collar 96, shown in FIG. 7 and which is shown in FIG. 4 installed on the locking pin 72.

Figure 8:
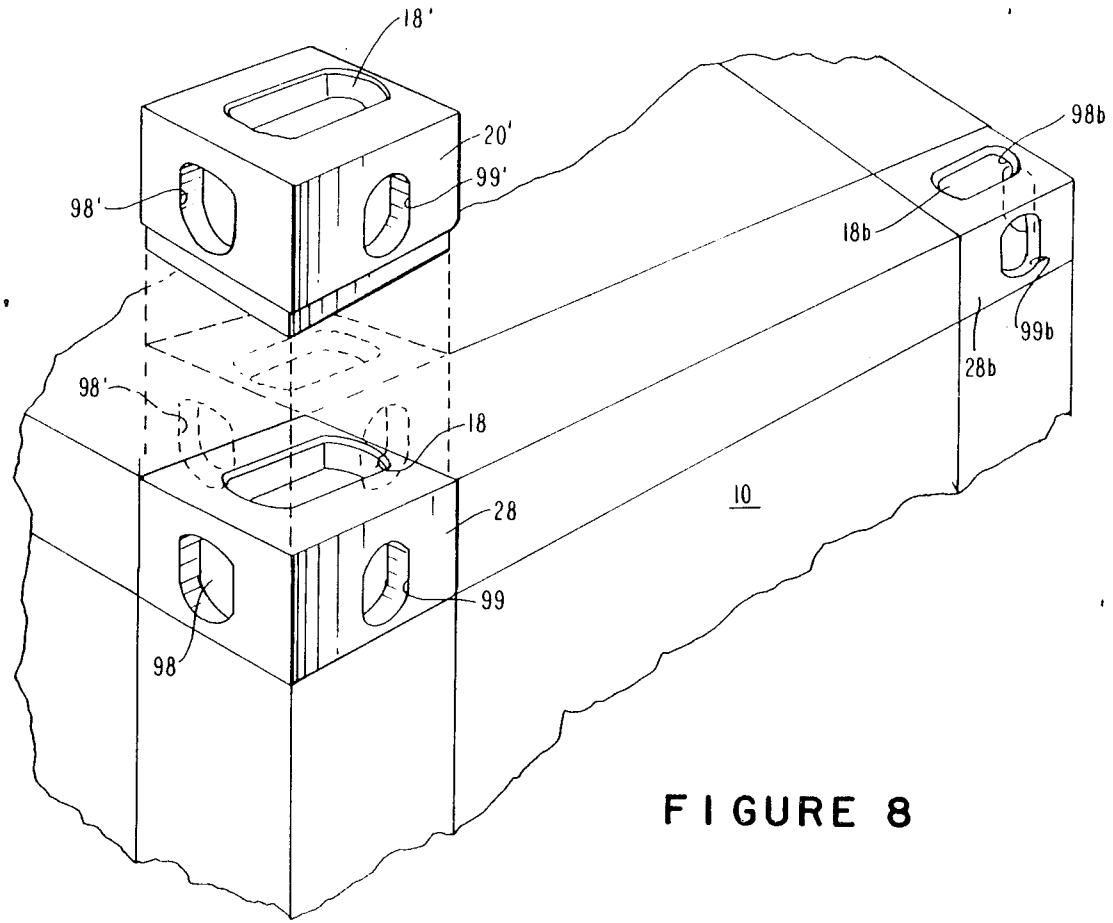
FIG. 8 is an enlarged exploded view of a corner fitting adaptor and its position when placed upon a standard ISO container corner fitting.

Referring now to FIG. 8, an edge of a standard ISO container 10 with standard corner fittings 28 and 28*b* is shown. Each corner fitting 28 and 28*b* has a top orifice 18 and 18*b* and side orifices 98 and 98*b* and front orifices 99 and 99*b*. An additional corner fitting adapter 20, shown in solid lines may be welded onto the ISO container corner fittings 28 as shown by the broken lines.

In operation, the SCAMP 22 is attached to the ISO Container 10, via the corner fitting adapters 28, 28*a*, 28*b* and 28*c* (or 20, 20' . . . ) with the aid of the locking pin 72, locking collar 96 and locking bar 74 assembled as shown in FIG. 4 on each of the extensions 26, 26*a*, 26*b* and 26*c*. This is accomplished by attaching the locking bar 74 to the outer plate 64, via the shoulder through bolt 76 and bolt opening 78 and threading it into threaded aperture 65 provided in outer plate 64. The locking bar 74 is then positioned such that the locking pin 72 slidably inserts through the lock pin opening 84 and concentric bores 68 and 70 until the locking collar groove 92 is positioned between the inner and outer plates 60 and 64. The locking collar 96 may then be press fit into the locking collar groove 92.

The locking collar 96, when installed as set forth above, limits the motion of the locking pin 72 when it comes into contact with the inner and outer plates 60 and 64 and prevents the removal of the locking pin 72 from the extension 26. The locking pin 72 is moved in the direction of arrow 102 until the collar 96 is against outer plate 64.

After the aforesaid assembly has been accomplished, a fork lift truck 24 or other suitable lifting means, such as a hoist or block and fall, lifts the SCAMP 22 into proximity with the ISO container 10 such that the axis of the locking pin 72 of each extension 26 is in alignment with the axis of a corresponding side orifice 98 in corner fittings 28. Each locking bar 74 may then be lifted via handles 80 so that the locking pin 72 may be pushed, in the direction of arrow 104, into the side orifice 98 with which it is in alignment. Upon reaching the limit of axial travel permitted by the locking collar 96, the locking bar 74 may be lowered such that the spotfaced or relieved edge 86 slides into the locking bar groove 94 and restricts the withdrawal of the locking pin 72 from its position within each of the side orifices 98, 98*a*, 98*b* and 98*c*.

The above described operation is carried out at each extension portion 26 and secures the SCAMP 22 to the ISO container 10 until the maintenance task has been completed. Once assembled and lifted into position, an individual, not shown, standing on platform 40 may readily operate the controls 41 to position himself to the most advantageous position to perform his task. To disassemble the device, the SCAMP 22 is lowered to ground level with its weight supported by arm members 32 and 32a and leg members 34 and 34a. Thereafter, each locking bar 74 is lifted and the lock pin 72 withdrawn from its associated side orifice 96 and moved in the direction of arrow 102 as far as it will go.

The corner fitting adaptor 20 depicted in FIG. 8 is utilized to provide uncluttered attachment of the spreader rasping devices 16, 16a, 16b and 16c, to the top orifices 18', 18'' . . . , of the adapter 20 and to simultaneously permit unfettered insertion of the locking pin 72 into the side orifice 98', 98'' . . . , of the corner adapter fittings 20. While use of corner fitting adaptors 20 is preferred, the invention may be practiced without them.

Hereinbefore has been disclosed a compact detachable SCAMP apparatus that requires minimum storage space and which may be removable affixed to a standard ISO container to accomplish the maintenance tasks of much larger units. It will be understood that various changes in the details, materials, arrangements of parts and operational conditions which have been herein described and illustrated in order to explain the nature of the invention may be made by those skilled in the art within the principles and scope of the invention.

Having thus set forth the nature of the invention, what we claim is:

1. An apparatus for maintaining and inspecting a dockside container crane used for loading and unloading ISO containers between ground vehicles and cargo ships, said ISO container being provided with a plurality of corner fittings attached to the exterior corners of said ISO container, comprising:

(a) a generally flat base member;

(b) framework means affixed to one end of said base member, said framework means having at least two extensions, each of said extension being provided with mating fittings adapted to mate and cooperate with said corner fittings for removably attaching said framework means and said base member to said ISO container;

(c) turret means mounted on said base member, said turret means being rotatable relative to said base member;

(d) telescopically extending boom means having one end pivotally secured to said rotatable turret, said boom means being capable of elevating and declining relative to said base member;

(e) platform means affixed on the other end of said boom means; and (f) control means, disposed on said platform means, said control means being adapted to position said platform means at desired locations relative to said dockside container crane.

2. The apparatus of claim 1 further including corner adapter means attached to at least two of said corner fittings adapted to receive a conventional spreader device.

3. The apparatus of claim 1 wherein:

(a) said extensions are attached to said framework member on one end and the other end is provided with an opening, (b) a locking pin adapted to slidably enter and cooperate with said extension opening, said locking pin also being adapted to slidably engage and cooperate with an opening in a corresponding corner fitting.

4. The apparatus of claim 1 wherein said base member includes:

(a) leg means for supporting said base member at a predetermined height and attitude; and (b) at least two tine sockets having at least one open end, adapted to slidably receive the tines of a forklift therein, each of said tine sockets being fixedly attached to said base member at the opposite distal end of said framework member.

5. The apparatus of claim 1 wherein each said framework mating fitting comprises:

(a) an inner plate, said inner plate being affixed to each said framework means extensions, having, a first clearance aperture;

(b) an outer plate, said outer plate being provided with a second clearance aperture;

(c) spacer means affixed between said inner plate and said outer plate for defining a predetermined space therebetween;

(d) a locking pin, said locking pin being adapted to be slidably received by said first clearance aperture and said second clearance aperture disposed in line, said locking pin having;

(i) restraining means disposed along the length of said locking pin and disposed between said inner and outer plates in said space therebetween, said restraining means limiting the movement of said locking pin to the length of said predetermined space, and (ii) locking means provided outside of said predetermined space for locking said locking pin in position when said restraining means is disposed against said inner plate;

(e) locking bar means, said locking bar means being pivotably affixed to said outer plate and having;

(i) handle means for easily moving said locking bar means about its pivotal axis, and (ii) cooperating locking means, said cooperating locking means cooperating with said pin locking means for insuring that said locking pin remains in its locked position.

6. The apparatus of claim 5 wherein the pivotal axis of said locking bar comprises a threaded shoulder bolt, the threaded portion of said shoulder bolt being threaded into a threaded aperture provided in said outer plate.

7. The apparatus of claim 5 wherein said locking bar means further includes an elongated clearance aperture disposed generally in line with said first and said second clearance apertures, said locking pin locking means comprises a channel provided in locking pin disposed outside of said predetermined space and proximate said locking bar means when said restraining means is disposed proximate said inner plate, said elongated aperture being pivoted to engage said channel, thereby insuring that said locking pin remains in its locked position.

8. The apparatus of claim 3 wherein said mating fitting includes:

(a) a spacer affixed to each said extensions distal to said framework member and said extension opening;

(b) an outer plate affixed to said spacer parallel to said extension and having an opening the axis of which is coaxial with said extension opening and which permits the simultaneous slidable insertion of said locking pin into said coaxial openings;

(c) an end brace interposed between and attached to said extension and said outer plate distal to said spacer;

(d) a locking collar means affixed to said locking pin for preventing the withdrawal of said locking bar from said extension opening and said outer plate allowing said locking pin a limited range of axial motion;

(e) an elongated locking bar member having two ends, a front and back surface, a pivot opening extending through said locking bar from said front to said back surfaces proximate one end, and a lock opening extending parallel to said pivot opening proximate another end of said locking bar, said pivot opening adapted to slidably receive a pivot pin and affixes to said extension and retains said locking bar in pivotal association with said extension, said lock opening permitting the passage therethrough of said locking pin, said locking bar pivoting on said pivot pin and said lock opening engaging a circumferential groove provided in said locking pin, thereby restraining axial motion of said locking pin.

* * * * *